US011693352B2

(12) United States Patent
Abe

(10) Patent No.: US 11,693,352 B2
(45) Date of Patent: Jul. 4, 2023

(54) TONER CONVEYING DEVICE HAVING EASILY REPLACEABLE COMPONENTS

(71) Applicant: CANON KABUSHIKI KAISHA, Tokyo (JP)

(72) Inventor: Tsukasa Abe, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/697,254

(22) Filed: Mar. 17, 2022

(65) Prior Publication Data

US 2022/0299929 A1 Sep. 22, 2022

(30) Foreign Application Priority Data

Mar. 19, 2021 (JP) ..... 2021-046198

(51) Int. Cl.
*G03G 21/10* (2006.01)
*G03G 15/08* (2006.01)
(Continued)

(52) U.S. Cl.
CPC ..... *G03G 21/105* (2013.01); *G03G 15/0865* (2013.01); *G03G 15/0893* (2013.01);
(Continued)

(58) Field of Classification Search
CPC ..... G03G 21/105; G03G 15/0865; G03G 15/0893; G03G 15/1615; G03G 21/12;
(Continued)

(56) References Cited

U.S. PATENT DOCUMENTS 2,443,288 A * 6/1948 Anderson ..... B65G 33/32 198/666
2,492,915 A * 12/1949 Carlson ..... B65G 33/32 29/889

(Continued)

FOREIGN PATENT DOCUMENTS

DE 1130358 B * 4/1959
JP 2002108170 A 4/2002

(Continued)

*Primary Examiner* — Arlene Heredia
*Assistant Examiner* — Laura Roth
(74) *Attorney, Agent, or Firm* — Rossi, Kimms & McDowell LLP

(57) ABSTRACT

A toner conveying device for conveying toner, comprising: a first conveying portion; and a second conveying portion conveying the toner conveyed from the first conveying portion. The first conveying portion further includes: a first screw which includes a first rotation shaft and a first blade portion, the first screw including an engaging portion and a first protruded portion on a first end portion; and a first conveying passage forming member having a first inner wall face which forms a first conveying passage. The second conveying portion includes: a second screw which includes a second rotation shaft and a second blade portion, the second screw including an engaged portion and a second protruded portion on a second end portion; and a second conveying passage forming member having a second inner wall face which forms a second conveying passage, and which is connected with the first conveying passage forming member.

10 Claims, 7 Drawing Sheets

(51) Int. Cl.
*G03G 15/16* (2006.01)
*G03G 21/12* (2006.01)
*G03G 21/16* (2006.01)

(52) U.S. Cl.
CPC ..... *G03G 15/1615* (2013.01); *G03G 21/12* (2013.01); *G03G 21/1647* (2013.01); *G03G 2221/1624* (2013.01)

(58) Field of Classification Search
CPC ..... G03G 2221/1624; G03G 21/10; G03G 15/0891; G03G 2215/0827; G03G 2215/0833; G03G 21/1647
See application file for complete search history.

(56) References Cited

U.S. PATENT DOCUMENTS

| | | | | |
|---|---|---|---|---|
| 10,901,342 | B2 * | 1/2021 | Sako | G03G 15/0853 |
| 10,962,918 | B2 | 3/2021 | Nakayashiki | |
| 2003/0175050 | A1 * | 9/2003 | Murayama | G03G 15/0893 399/256 |
| 2016/0313675 | A1 * | 10/2016 | Kim | G03G 15/0879 |
| 2021/0216028 | A1 * | 7/2021 | Yoshihira | G03G 15/0853 |

FOREIGN PATENT DOCUMENTS

| | | | | |
|---|---|---|---|---|
| JP | 2002244529 | A | | 8/2002 |
| JP | 2012181477 | A | * | 9/2012 |
| JP | 2014186090 | A | | 10/2014 |
| JP | 2014225045 | A | | 12/2014 |
| JP | 2021009177 | A | | 1/2021 |

* cited by examiner

TONER CONVEYING DEVICE HAVING EASILY REPLACEABLE COMPONENTS

BACKGROUND OF THE INVENTION

Field of the Invention

The present invention relates to a toner conveying device that conveys toner.

Description of the Related Art

In an image forming apparatus, such as a printer, a copier or a facsimile, using an electro-photographic system, a configuration to convey toner from a toner storing portion to an image forming portion via a toner conveying means may be used. For example, Japanese Patent Application Publication No. 2002-244529 discloses a configuration to convey toner contained in a toner bottle disposed in a lower part of an image forming portion to a developing apparatus of the image forming portion in a direction against gravity, via a toner conveying passage extending upward from the toner bottle by using air flow. Here, depending on the layout of each portion of the image forming apparatus, the toner conveying passage may be disposed extending over various components.

SUMMARY OF THE INVENTION

In recent years, image forming apparatuses have achieved long life by appropriate replacement of functional units. In some cases, when a toner conveying unit is replaced to extend the life of the image forming apparatus, the man-hours of replacing the toner conveying unit may increase, depending on the layout of each component of the image forming apparatus. For example, the toner conveying unit may be disposed in a wide area, extending over a paper feeding portion, a conveying portion and an image forming portion. In the case of this configuration, removing many components, such as each unit of the paper feeding portion, conveying portion and image forming portion, and the stays that support each unit, may be required in order to remove the toner conveying unit.

It is an object of the present invention to provide a technique to reduce man-hours in the maintenance operation for the image forming apparatus.

To achieve the above object, a toner conveying device for conveying toner, according to the present invention, comprises:

a first conveying portion configured to convey the toner; and a second conveying portion configured to convey the toner conveyed from the first conveying portion, wherein the first conveying portion comprising:

a first screw that is rotatable around a first rotational axis and includes a first rotation shaft and a first blade portion which has a helix shape with the first rotational axis as a helical axis and is disposed on an outer peripheral surface of the first rotation shaft, the first screw including, in a first end portion in a direction of the first rotational axis, an engaging portion, and a first protruded portion protruded from the first rotation shaft in a direction intersecting with the first rotational axis; and a first conveying passage forming member having a first inner wall face which forms a first conveying passage inside which the first screw is disposed, the first inner wall face extending in the direction of the first rotational axis, so as to overlap with the first protruded portion in a view in the direction orthogonal to the first rotational axis, the second conveying portion comprising:

a second screw that is rotatable around a second rotational axis and includes a second rotation shaft and a second blade portion which has a helix shape with the second rotational axis of the second rotation shaft as a helical axis and is disposed on an outer peripheral surface of the second rotation axis, the second screw including, in a second end portion of the second rotation shaft, an engaged portion, which engages with the engaging portion of the first screw so that the second screw is rotated by the rotation of the first screw, and a second protruded portion protruded from the second rotation shaft in a direction intersecting with the second rotational axis; and a second conveying passage forming member having a second inner wall face which forms a second conveying passage inside which the second screw is disposed and is connected with the first conveying passage forming member, the second inner wall face extending in the direction of the second rotational axis, so as to overlap with the second protruded portion in a view in the direction orthogonal to the second rotational axis.

According to the present invention, man-hours can be reduced in the maintenance operation for the image forming apparatus.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 5:
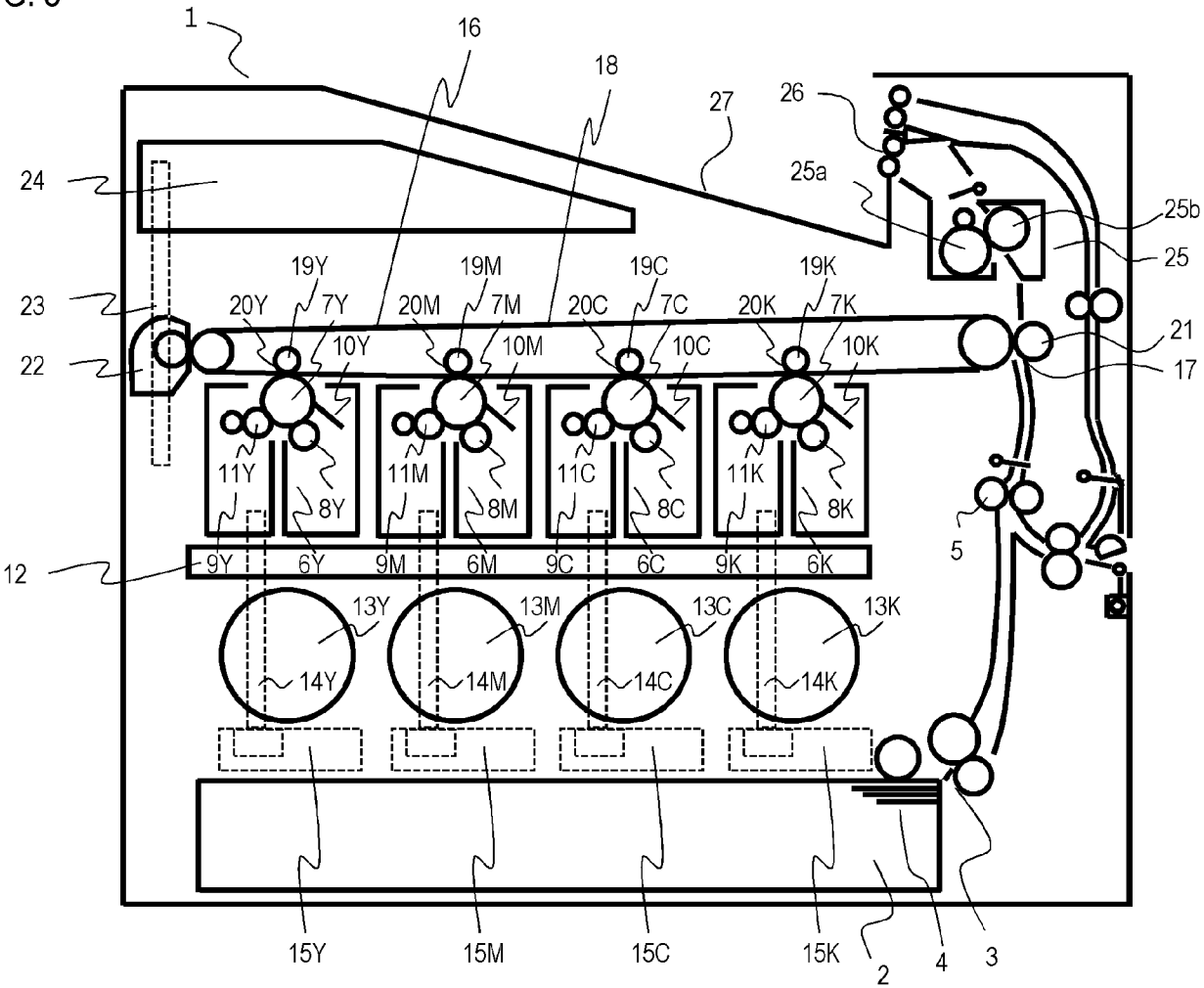
FIG. 5 is a schematic cross-sectional view of an image forming apparatus according to Embodiments 1 and 2 of the present invention.

FIG. 5 is a schematic diagram of a general configuration of an image forming apparatus 1 according to an embodiment of the present invention. FIG. 5 indicates a configuration of the image forming apparatus 1 when the image forming apparatus 1 is disposed on a horizontal installation surface, which is a normally assumed installation state, and the left-right direction in FIG. 5 is the horizontal direction, and the top-bottom direction in FIG. 5 is the vertical direction of the apparatus.

The image forming apparatus 1 includes an image forming portion 6 (image forming unit) where image forming stations 6Y, 6M, 6C and 6K corresponding to the toner (developer) of each color: yellow (Y), magenta (M), cyan (C) and black (K), are disposed in a row. The image forming portion 6 includes: photosensitive drums 7Y, 7M, 7C and 7K (hereafter photosensitive drum 7), which are image bearing members; and charging apparatuses 8Y, 8M, 8C and 8K (hereafter charging apparatus 8), which uniformly charge the surfaces of the respective photosensitive drums 7. Further, in the image forming portion 6, developing apparatuses 9Y, 9M, 9C and 9K (hereafter developing apparatus 9), which develop a toner image (developer image) by attaching toner to the electrostatic latent image, are disposed. Furthermore, the image forming portion 6 includes photosensitive member cleaning blades 10Y, 10M, 10C and 10K (photosensitive member cleaning blade 10), which remove untransferred toner remaining on the photosensitive drum 7. In the developing apparatus 9, a developing roller 11Y, 11M, 11C or 11K (developing roller 11), corresponding to each color, is disposed so as to be capable of contacting with or separating from each photosensitive drum 7. By contacting or separating the developing roller 11 in accordance with the formed electrostatic latent image, that is, in accordance with the necessities of development, the life of the developing roller 11 is extended. A scanner unit 12 that emits a laser beam, based on the image information, and forms an electrostatic latent image on the photosensitive drum 7, is disposed below the image forming portion 6.

Each image forming station 6Y, 6M, 6C and 6K is configured as a process cartridge that is detachable from the apparatus main unit of the image forming apparatus 1. The process cartridge is configured such that the developing apparatus 9, which includes the developing roller 11, and the photosensitive member unit, which includes the photosensitive drum 7, the charging apparatus 8 and the photosensitive member cleaning blade 10, can be detachable from the apparatus main unit independently or integrally.

In the present embodiment, the developing apparatus 9 includes a dedicated toner containing chamber, and toner supplied from a replenishing toner container (toner cartridge) 13, which is a containing portion, is replenished in the toner containing chamber. Here, the apparatus main unit of the image forming apparatus 1 refers to a portion of the image forming apparatus 1 after removing detachable components, such as the above mentioned process cartridges and replenishing toner containers 13.

A cassette 2 is retractably housed in the lower part of the image forming apparatus 1. In the cassette 2, recording materials 4 (e.g. paper and sheets) are stored. The recording materials 4 are separated and fed one by one by the rotation of a cassette feeding portion 3 disposed near the front end of the recording materials 4. Then the recording materials 4 are transported to the downstream side by a resist roller 5.

An intermediate transfer unit 16 is disposed above the developing apparatus 9. The intermediate transfer unit 16 is disposed in an approximately horizontal position such that the side facing each image forming station (image forming portion) 6 (that is, the primary transfer portion 20 side) faces downward. An intermediate transfer belt 18, which faces each photosensitive drum 7, is a rotatable endless belt and is stretched around a plurality of stretching rollers. On the inner surface side of the intermediate transfer belt 18, primary transfer rollers 19Y, 19M, 19C and 19K (primary transfer roller 19) are disposed as primary transfer members. Each primary transfer roller 19 is disposed at a position to form each primary transfer portion 20Y, 20M, 20C and 20K (primary transfer portion 20) with each photosensitive drum 7 via the intermediate transfer belt 18 respectively. In each primary transfer portion 20, a toner image is transferred from each photosensitive drum 7 to the intermediate transfer belt 18 by the primary transfer roller 19 to which voltage is applied. In the present embodiment, a unit constituted of the intermediate transfer belt 18, a plurality of stretching rollers to stretch the intermediate transfer belt 18, and each primary transfer roller 19, is detachably installed as the intermediate transfer unit 16.

A toner image developed in each image forming station is transferred to the intermediate transfer belt 18 in the primary transfer portion 20. By sequentially transferring each color of the toner image, a four-color toner image is formed on the surface of the intermediate transfer belt 18, and is conveyed to a secondary transfer portion 17.

Below the image forming portion 6, the replenishing toner containers 13Y, 13M, 13C and 13K (replenishing toner container 13) to replenish toner to each image forming station (image forming portion) 6 are disposed roughly in the horizontal direction between the scanner unit 12 and the cassette 2, so as to be detachable from the image forming apparatus 1. The replenishing toner container 13, which is also called a "toner replenishing cartridge", contains toner. Toner for replenishment corresponding to each color is filled inside the replenishing toner container 13. In accordance with consumption of the toner inside the image forming portion 6, a toner conveying device 14Y, 14M, 14C or 14K (toner conveying device 14) conveys toner received from the replenishing toner container 13 to the upper side, so as to supply toner to the developing apparatus 9. The toner conveying device 14 conveys toner used for image formation. The toner conveying device 14, which is a toner conveying portion, is driven by a toner conveying driving apparatus 15Y, 15M, 15C or 15K (toner conveying driving apparatus 15) which is a driving unit disposed below the toner conveying device 14. The toner conveying driving apparatus 15 includes: a motor, which is a power source to provide a driving force to drive each screw of the toner conveying device 14 to the toner conveying device 14 via a later mentioned upstream side driving gear 103, an upper conveying driving gear 112, and the like; and a gear which is a driving force transfer unit.

A secondary transfer roller 21, which is a secondary transfer member, contacts with the intermediate transfer belt 18, and forms a secondary transfer portion 17 with the roller on the opposite side, via the intermediate transfer belt 18. The toner image transferred to the intermediate transfer belt 18 by the secondary transfer portion 17 is secondarily transferred to the recording material 4. Toner, which is not transferred to the recording material 4 in the secondary transfer and remains on the intermediate transfer belt 18, is removed by a cleaning unit 22. The toner removed by the cleaning unit 22 is conveyed to a toner collection container 24 via a toner conveying passage 23, and toner is stored in the toner collection container 24.

The recording material 4, on which the unfixed toner image is transferred, is conveyed further downstream, and is then pressed and heated by a heating unit 25*a* and a pressure roller 25*b* of a fixing apparatus 25. Thereby the toner is melted and the toner image is fixed to the recording material 4. Then the recording material 4 is conveyed to a discharging roller pair 26, and is discharged to a delivery tray 27. By this series of operations, an image is formed on the surface of the recording material 4.

Toner Conveying Device

Figure 1:
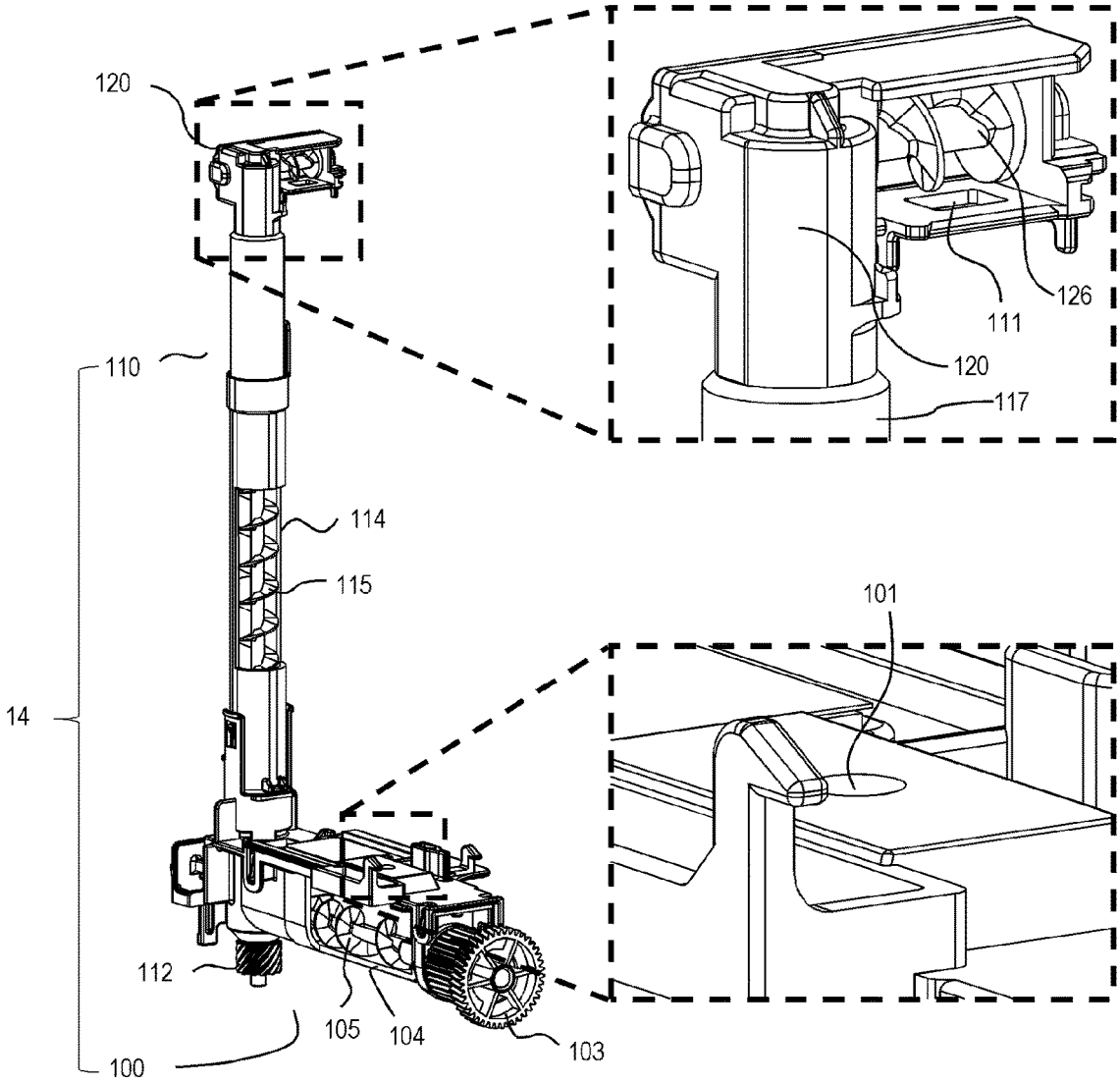
FIG. 1 is a perspective view of a toner conveying device according to Embodiment 1 of the present invention.

FIG. 1 is a schematic perspective view depicting a general configuration of the toner conveying device 14 installed in the image forming apparatus 1 of the present embodiment. In the illustration of FIG. 1, a part of the configuration is omitted in order to indicate the internal configuration of the toner conveying device 14.

The toner conveying device 14 is roughly constituted by an upstream side conveying portion 100 and an upper conveying portion (downstream side conveying portion) 110, which is disposed on the downstream side of the upstream side conveying portion 100.

Upstream Side Conveying Portion 100

A supply port 101 is disposed on the upper face of the upstream side conveying portion 100, and via this supply port 101, toner supplied from the replenishing toner container 13 illustrated in FIG. 5 is supplied into the toner conveying passage, which is formed by an upstream side wall face 104 inside the upstream side conveying portion 100. The supplied toner is conveyed by the rotation of an upstream side screw 105, which is disposed inside the upstream side conveying portion 100, so as to be covered by the upstream side wall face 104. An upstream side screw 105 is rotary-driven by the rotary driving force, which is transferred from the toner conveying driving apparatus 15 to the upstream side driving gear 103, and conveys the toner in the direction toward the downstream side conveying portion 110.

The upstream side conveying portion 100 includes a portion constituting an upstream side toner conveying passage (horizontal toner conveying passage) 108, and a portion constituting a part of the upstream side of a downstream side toner conveying passage (vertical toner conveying passage) 109. The upstream side screw 105 includes a rotation shaft 105A and a blade portion 105B, which is helix-shaped, so as to be helically wound around the outer periphery of the rotation shaft 105A. The upstream side screws 105 is disposed inside the toner conveying passage 108 extending roughly in the horizontal direction, among the conveying passages formed by the upstream side conveying portion 100, so as to be rotatable around the rotational axis of the rotation shaft 105A in the position extending roughly in the horizontal direction.

A part of the upstream side of the toner conveying passage 109, which is formed in the upstream side conveying portion 100, has an upstream side end at the tip of an opening of the toner conveying passage 108, which opens in the axial direction of the rotation shaft 105A, and from there extends upward (direction against gravity). In other words, the conveying passage formed by the upstream side conveying portion 100 is formed approximately in an L shape, and is constituted of the toner conveying passage 108 and a part 109*a* of the upstream side of the toner conveying passage 109.

Upper Conveying Portion (Downstream Side Conveying Portion) 110

The upper conveying portion 110 forms the toner conveying passage 109 which extends roughly in the vertical direction (direction against gravity) on the downstream side of the toner conveying passage 108. The upper conveying portion 110 forms most part 109*b* of the toner conveying passage 109, excluding a part 109*a* of the upstream side portion of the toner conveying passage 109 formed by the upstream side conveying portion 100. In other words, in the toner conveying passage 109 which extends roughly in the vertical direction, a part 109*a* of the upstream side portion (lower side portion in the vertical direction) is formed by the upstream side conveying portion 100, and a part 109*b* on the downstream side (upper side in the vertical direction) from there is formed by the upper conveying portion 110. In other words, the toner conveying passage 109 is disposed extending over the upstream side conveying portion 100 and the upper conveying portion 110.

The upstream side conveying portion 100 has an opening which opens the toner conveying passage 109 upward, and the lower end (upstream side end) of the upper conveying portion 110 is inserted into the opening from above, so as to connect with the upstream side conveying portion 100. By this connection, a toner conveying passage 109*a* of the upstream side conveying portion 100 and a toner conveying passage 109*b* of the upper conveying portion 110 are linked, whereby a single second toner conveying passage 109 is formed.

An upper conveying upstream screw 115 (first screw) is rotatably disposed inside the toner conveying passage 109, so as to extend in the vertical direction, and is housed extending over the inside (109*b*) of the upper conveying portion 110 and inside (109*a*) of the upstream side conveying portion 100. An upper conveying downstream screw 118 (second screw) is connected to the upper conveying upstream screw 115 on the downstream side (upper part) of the toner conveying passage 109, and is rotatably disposed inside the toner conveying passage 109, so as to extend in the vertical direction, and is housed inside (109*b*) the upper conveying portion 110. The most upstream part of the upper conveying portion 110 is connected to the most downstream part of the upstream side conveying portion 100, and the toner, which was conveyed in the roughly horizontal direction by the upstream side screw 105 of the upstream side conveying portion 100, is conveyed in the roughly vertical direction by the upper conveying upstream screw 115 and the upper conveying downstream screw 118.

The upper conveying upstream screw 115 is disposed inside the upper conveying portion 110, so as to be covered (surrounded) by an upper conveying upstream wall face 114 thereof. The upper conveying upstream screw 115 includes a rotation shaft 115A (first rotation shaft), and a blade portion 115B (first blade portion) which is helix-shaped, so as to be helically wound around the outer periphery (outer peripheral surface) of the rotation shaft 115A with the rotational axis (first rotational axis) of the rotation shaft 115A as the helical axis. The upper conveying downstream screw 118 is disposed inside the upper conveying portion 110, so as to be covered by an upper conveying downstream wall face 117 thereof. The upper conveying downstream screw 118 includes a rotation shaft 118A (second rotation shaft), and a blade portion 118B (second blade portion) which is helix-shaped, so as to be helically wound around the outer periphery (outer peripheral surface) of the rotation shaft 118A with the rotational axis (second rotational axis) of the rotation shaft 118A as the helical axis. In the present embodiment, the upper conveying upstream screw 115 and the upper conveying downstream screw 118 are disposed so that both the rotational axes of the rotation shaft 115A and the rotation shaft 118A extend in the gravity direction.

A downstream side end portion 115C of the rotation shaft 115A of the upper conveying upstream screw 115 and an upstream side end portion 118C of the rotation shaft 118A of the upper conveying downstream screw 118 have engaging portions respectively, which can engage with each other in the rotation direction. Configuration of the engaging portions will be described later.

Figure 2A:
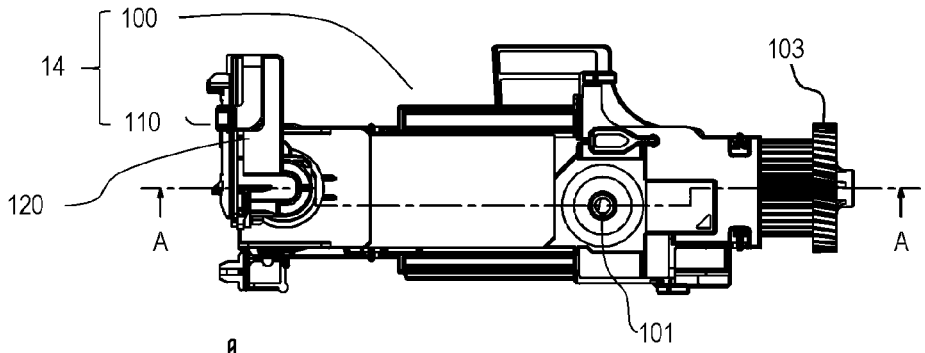
FIGS. 2A and 2B are views depicting a configuration of the toner conveying device in an assembled state according to Embodiment 1 of the present invention.
Figure 2B:
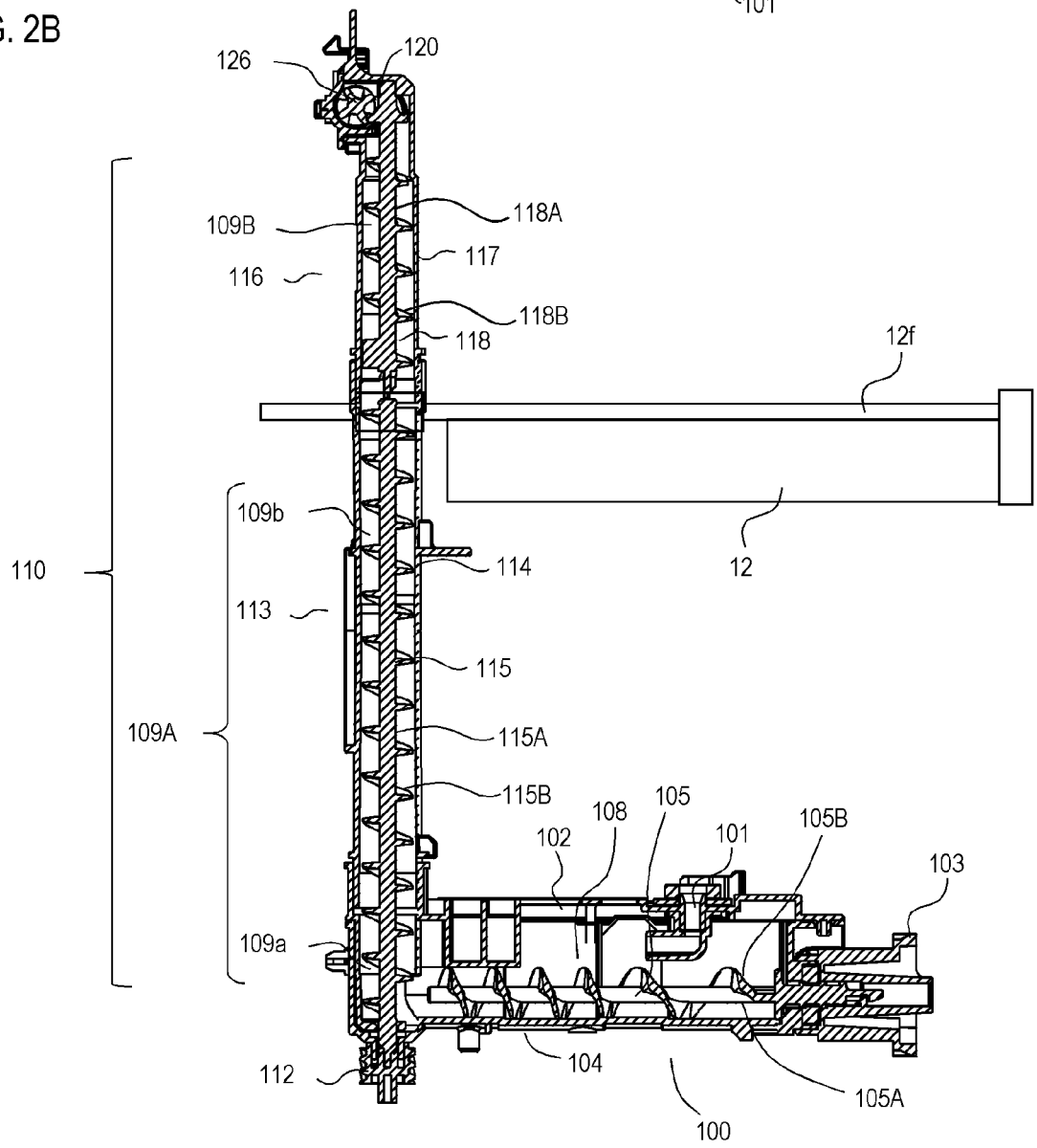

FIGS. 2A and 2B are schematic views depicting the toner conveying device 14 in an assembled state, where FIG. 2A is a plan view when the toner conveying device 14 is viewed from the top, and FIG. 2B is a schematic cross-sectional view of the toner conveying device 14 at the A-A line in FIG. 2A. In other words, FIGS. 2A and 2B indicate the state where the engaging portions of the upper conveying upstream screw 115 and the upper conveying downstream screw 118 are engaged, and an upper conveying upstream member 113 and an upper conveying downstream member 116 are connected, so as to form one toner conveying passage where toner is conveyed upward in the vertical direction.

The upper conveying upstream screw 115 is rotary-driven by the rotary driving force that is transferred from the toner conveying driving apparatus 15 to an upper conveying driving gear 112. The upper conveying upstream screw 115 conveys toner in the opposite direction of gravity in the upstream side conveying passage 109A (first toner conveying passage) out of the toner conveying passage 109 in a first conveying space (first conveying portion). The upper conveying downstream screw 118 is rotary-driven with the rotational axis of the rotation shaft 108A as the center, by the rotary driving force that is transferred from the rotating upper conveying upstream screw 115 via the above mentioned engaging portions. The upper conveying downstream screw 118 further conveys the toner conveyed by the upper conveying upstream screw 115 in the opposite direction of gravity in the downstream side conveying passage 109B (second toner conveying passage) of the toner conveying passage 109 in a second conveying space (second conveying portion). In other words, the second conveying portion is located above the first conveying portion, and the rotational axes of the upper conveying upstream screw 115 of the first conveying portion and the upper conveying downstream screw 118 of the second conveying portion are both extended upward.

The toner conveyed by the upper conveying upstream screw 115 and the upper conveying downstream screw 118 in the opposite direction of gravity is further conveyed in a horizontal conveying portion 120 by a discharging screw 126 in the horizontal direction. Then the toner is discharged from the upper conveying portion 110 to outside of the conveying portion via a discharging port 111 (see FIG. 1). The toner discharged to outside of the conveying portion is replenished in the developing apparatus 9 illustrated in FIG. 5.

Figure 3A:
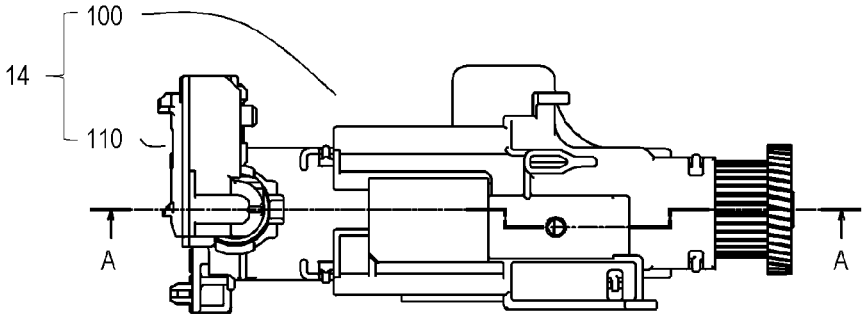
FIGS. 3A and 3B are views depicting a configuration of the toner conveying device in a disassembled state according to Embodiment 1 of the present invention.
Figure 3B:
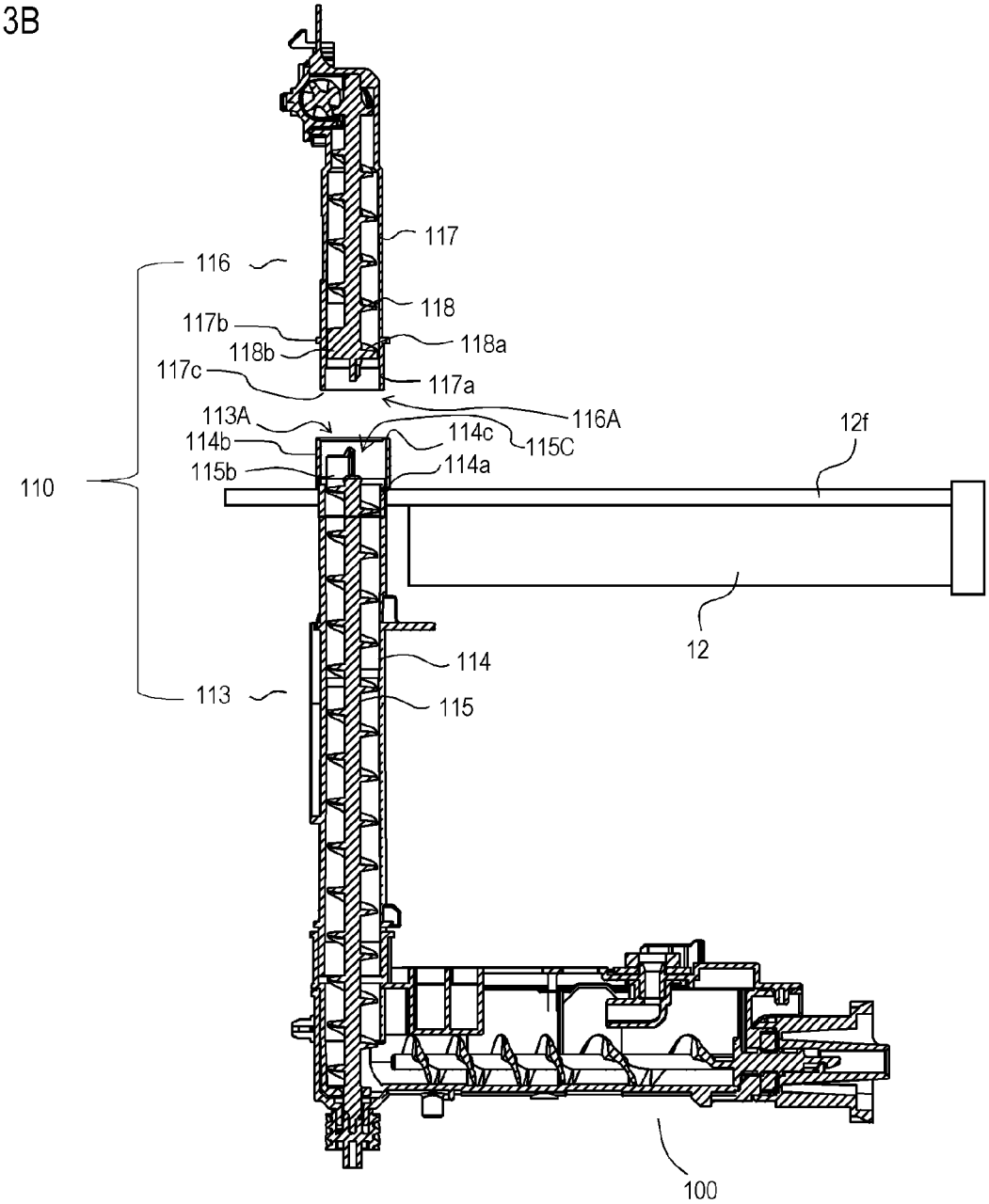

FIGS. 3A and 3B are schematic views depicting the toner conveying device 14 in a disassembled state, where FIG. 3A is a plan view when the toner conveying device 14 is viewed from the top; and FIG. 3B is a schematic cross-sectional view of the toner conveying device 14 at the A-A line in FIG. 3A. In other words, FIGS. 3A and 3B indicate a state where the engaging portions of the upper conveying upstream screw 115 and the upper conveying downstream screw 118 are disconnected, and the upper conveying upstream member 113 and the upper conveying downstream member 116 are also disconnected.

A cylindrical engaging portion 114*b*, which is extended upward from the upper conveying upstream wall face 114 with an expanding diameter, is disposed on the outer periphery of an opening 113A of the upper conveying upstream member 113. This engaging portion 114*b* is configured to be recessed-shaped, which surrounds the outer periphery of the bottom end portion of the upper conveying downstream member 116, which includes an opening 116A. In other words, the upper conveying upstream wall face 114 has an inner wall face 114*a* of which diameter expands in the engaging portion 114*b*. A cylindrical end portion (second cylindrical end portion) 117*a* at the bottom end of the upper conveying downstream member 116 is fitted into this inner wall face 114*a*, whereby the upper conveying upstream wall face 114 and the upper conveying downstream wall face 117 form a continuous inner wall face which constitutes one toner conveying passage. In other words, the upper conveying upstream member 113 and the upper conveying downstream member 116 are connected such that the inner wall face 114*a* covers the cylindrical end portion 117*a* from the outside. In the state where the upper conveying upstream member 113 and the upper conveying downstream member 116 are connected, a ring-shaped downstream end portion (tip) 114*c* of the cylindrical engaging portion 114*b* contacts a flange portion 117*b* disposed on the outer surface of the upper conveying downstream member 116. A ring-shaped upstream end portion (tip) 117*c* of the cylindrical end portion (second cylindrical end portion) 117*a* at the lower end of the upper conveying downstream member 116 contacts a diameter expansion step surface of the engaging portion 114*b* on the upper conveying upstream wall face 114 of the upper conveying downstream member 116. Thereby the positions of the upper conveying upstream member 113 and the upper conveying downstream member 116 in the axial direction (vertical direction) are determined.

The engaging portion 114*b* disposed in the upper conveying upstream member 113 has, above the engaging portion side end portion (upper end) 115C of the upper conveying upstream screw 115, a wide containing space to receive toner falling from the opening 116A of the upper conveying downstream member 116 (toner receiving portion). Further, in the state where the upper conveying upstream member 113 and the upper conveying downstream member 116 are connected, the engaging portion 114*b* is extended on the upstream side from the upstream end portion 117*c* of the upper conveying downstream wall face 117, so as to cover a part of the outer periphery of the upper conveying downstream member 116. The connectivity between the upper conveying upstream member 113 and the upper conveying downstream member 116 can be improved by the engaging portion 114*b* engaging so as to surround the outer periphery of the lower end portion of the upper conveying downstream member 116 including the opening 116A. Therefore in Embodiment 1, more toner can be held by expanding the space between the downstream end portion 114*c* of the upper conveying upstream wall face 114 and the downstream side blade end portion 115*a* of the upper conveying upstream screw 115.

Figure 4A:
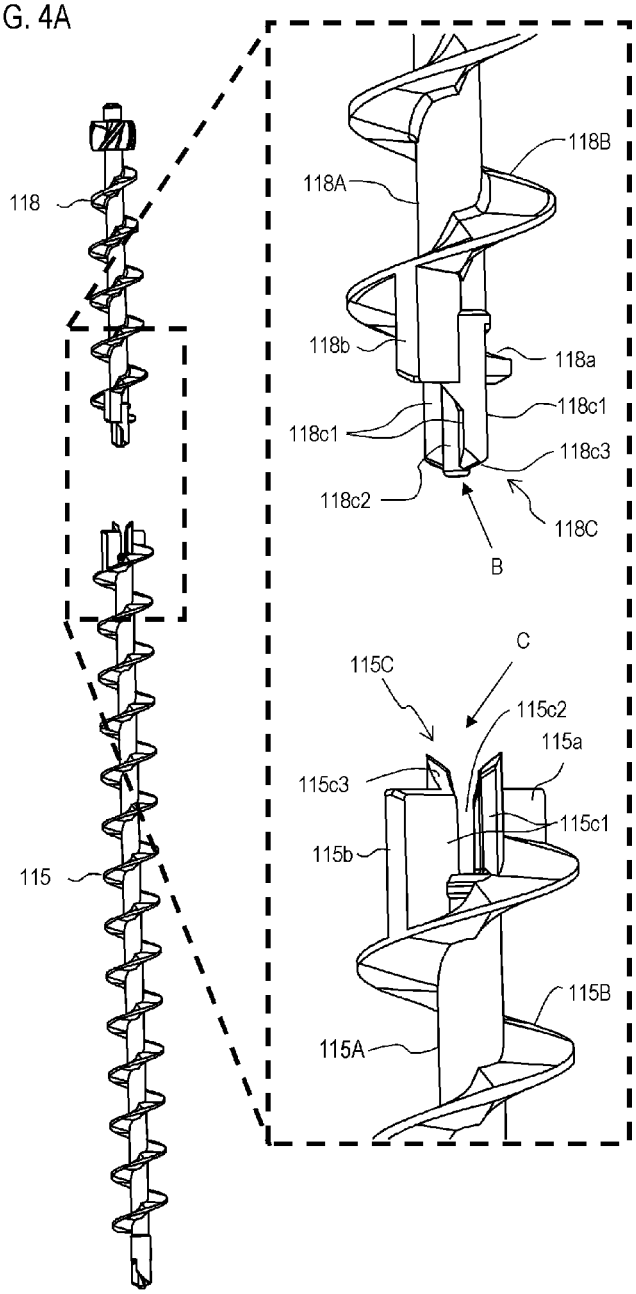
FIGS. 4A to 4C are views depicting a configuration of the toner conveying device in a disassembled state according to Embodiment 1 of the present invention.
Figure 4B:
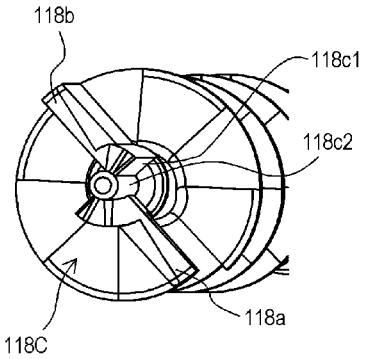
Figure 4C:
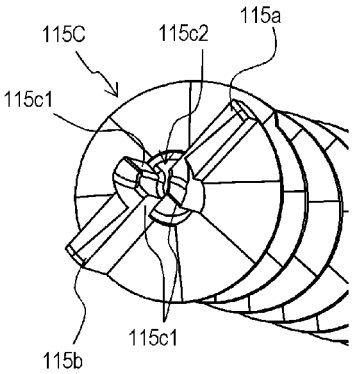

FIGS. 4A to 4C are views depicting a configuration of the engaging portions of the upper conveying upstream screw 115 and the upper conveying downstream screw 118, and a configuration of a later mentioned regulating portion, where FIG. 4A is a schematic view depicting a general configuration of both screws, FIG. 4B is an arrow view in the direction B in FIG. 4A, and FIG. 4C is an arrow view in the direction C in FIG. 4A. FIGS. 4A to 4C indicate a state where both screws are disengaged (state where the upper conveying upstream screw 115 and the upper conveying downstream screw 118 are separated in the axial direction). The downstream side end portion 115C (first end portion on the first opening side) of the rotation shaft 115A of the upper conveying upstream screw 115 and the upstream side end portion 118C (second end portion on the second opening side) of the rotation shaft 118A of the upper conveying downstream screw 118 have recessed/protruded portions that can be engaged with each other. The recessed/protruded portions include a driving transfer face 115*c*1 (first engaging face) disposed in the downstream side end portion 115C, and a driving transfer face 118*c*1 (second engaging face) disposed in the upstream side end portion 118C. These driving transfer faces, which extend in the direction parallel with the axial direction of the rotation shaft and the diameter direction, contact with each other in the rotating direction of the screw on the outer diameter side of the recessed/protruded portions, whereby the rotary-driven force can be transferred. The recessed/protruded portions of the present embodiment are constituted of a protruded portion 118*c*2 (engaged portion), which is protruded in the axial direction in the upstream side end portion 118C, and a recessed portion 115*c*2 (engaging portion), which is recessed in the axial direction, in the downstream side end portion 115C, so that the protruded portion 118*c*2 can be fitted. In the upstream side end portion 118C, the driving transfer face 118*c*1 is disposed on the outer periphery of the protruded portion 118*c*2, and in the downstream side end portion 115C, the driving transfer face 115*c*1 is disposed on the outer periphery of the recessed portion 115*c*2. Further, on the respective tip sides of the downstream side end portion 115C and the upstream side end portion 118C, guide faces 115*c*3 and 118*c*3, which are inclined so as to slide with each other in the rotating direction, are disposed, so that the downstream side end portion 115C and the upstream side end portion 118C can be engaged while aligning the rotational axes of the screws and the phases thereof in the rotation direction (while cancelling the shift of the rotational axes and phase shift). In other words, by the recessed portion 115*c*2 (engaging portion) disposed on the end face of the rotation shaft 115A fitting with the protruded portion 118*c*2 (engaged portion) disposed on the end face of the rotation shaft 118A, the upper conveying upstream screw 115 and the upper conveying downstream screw 118 are engaged. In the upstream side end portion 118C, a different driving transfer face, which faces the driving transfer face 118*c*1, is disposed, and in the downstream side end portion 115C as well, a different driving transfer face, facing the driving transfer face 115*c*1, is disposed (not illustrated), and these driving transfer faces also contact with each other in the rotation direction. The configuration of the engaging portion is not especially limited, and the configuration described above is merely an example.

Assembly/Disassembly of Toner Conveying Device 14

A state of assembly/disassembly of the toner conveying device 14 in a case of service (maintenance) or the like, and regulating portions disposed in the upper conveying upstream screw 115 and the upper conveying downstream screw 118 respectively, will be described with reference to FIGS. 2A, 2B, 3A, 3B, and 4A to 4C.

As illustrated in FIG. 2, the upper conveying portion 110 is configured such that the upper conveying upstream member 113, which is a first conveying passage forming member constituting the first toner conveying portion, and the upper conveying downstream member 116, which is a second conveying passage forming member constituting the second toner conveying portion, are separably connected. This means that the upper conveying portion 110 is constituted of the first toner conveying portion and the second toner conveying portion. One reason this configuration is used is because the upper conveying portion 110 needs to be long and narrow, and needs to be manufactured in sections due to the restrictions of the dies. In other words, there is a length limitation to manufacture a long and narrow member using a single die. Specifically, various members constituting a conveying passage in the toner conveying device of the present embodiment are formed by resin, and standard resin components are manufactured by injection molding. While standard resin components are manufactured by injection molding, the metal die used for injection molding requires a mold strength that can withstand mass production. In the case of a long and narrow component, this mold strength is low, so either the tube needs to be thick or short. In the configuration of the present embodiment, the tube cannot be thick, hence the tube needs to be divided into a plurality of composing elements, so that these composing elements are individually molded using a plurality of dies respectively, and one long and narrow member is created by connecting these separate composing elements. This is because the upper conveying portion 110 needs to be disposed extending over the scanner stay (exposure apparatus support portion of the device main unit) 12*f* that supports the scanner unit 12 from the bottom up. As mentioned above, the upper conveying upstream screw 115 disposed inside the upper conveying upstream member 113 and the upper conveying downstream screw 118 disposed inside the upper conveying downstream member 116 are engaged and driven in tandem.

In the upper conveying upstream member 113, the opening 113A (first opening) that opens upward is disposed at the downstream end of the toner conveying passage 119A. In the upper conveying downstream member 116, the opening 116A that opens downward is disposed at the upstream end of the toner conveying passage 119B. The upper conveying upstream member 113 and the upper conveying downstream member 116 are configured to be connectable to each other, so that the opening 113A and the opening 116A are connected, and the toner conveying passage 119A and the toner conveying passage 119B form one toner conveying passage 119.

By dividing the upper conveying portion 110 like this, the upper conveying side downstream member 116 can be disassembled above the scanner stay 12*f*, and the upper conveying upstream member 113 and the upstream conveying portion 100 can be disassembled (disconnected) below the scanner stay 12*f*, and a downstream side tip portion, which is a part of the upper conveying upstream member 113, protrudes upward from the scanner stay 12*f*, while most of the upper conveying upstream member 113 is disposed below the scanner stay 12*f*. In other words, the service replacement (maintenance operation) of the toner conveying device 14 can be performed without removing the scanner stay 12*f*.

Here, in order to assemble the toner conveying device 14, as illustrated in FIGS. 2A and 2B, from the disassembled state in FIGS. 3A and 3B, it is necessary to prevent engagement failure between the upper conveying upstream screw 115 and the upper conveying downstream screw 118. A major cause of engagement failure is misalignment between the upper conveying upstream screw 115 and the upper conveying downstream screw 118. In other words, in engagement, the rotational axis of the upper conveying upstream screw 115 and the rotational axis of the upper conveying downstream screw 118 need to be substantially aligned, but if these rotational axes are misaligned, the upper conveying upstream screw 115 and the upper conveying downstream screw 118 may not be engaged.

The upstream side end portion (lower end) of the upper conveying upstream screw 115 is assembled and fixed by the upper conveying driving gear 112 and the like. The downstream side end portion 115C (upper end) thereof, on the other hand, is free without support in the state of not engaging with the upstream side end portion 118C of the upper conveying downstream screw 118. In other words, the upper conveying upstream screw 115 has a swing configuration, where the lower end is fixed but the upper end, which is free without support, tends to be unstable, and is easily misaligned at the engaging portion with the upper conveying downstream screw 118.

The downstream side end portion (upper end) of the upper conveying downstream screw 118 is engaged with the discharging screw 126 in the horizontal conveying portion 120, so as to be drive-coupled, and is fixed. The upstream side end portion 118C (lower end) thereof, on the other hand, is free without support in the state of not engaging with the downstream side end portion 115C of the upper conveying upstream screw 115. In other words, the upper conveying downstream screw 118 has a swing configuration, where the upper end is fixed but the lower end, which is free without support, tends to be unstable, and is easily misaligned at the engaging portion with the upper conveying upstream screw 115.

In order to prevent the above mentioned misalignment, a regulating portion (protruded portion) to prevent misalignment is disposed in the upper conveying upstream screw 115 and the upper conveying downstream screw 118 respectively.

As illustrated in FIGS. 3A and 3B, for the upper conveying upstream screw 115, an upper conveying upstream screw first regulating portion 115*a* and an upper conveying upstream screw second regulating portion 115*b*, located at an opposing position of the upper conveying upstream screw first regulating portion 115*a*, are disposed, as the first regulating portion (protruded portion), at the downstream side end portion 115C, which is an end portion on the side where an engaging portion with the upper conveying downstream screw 118 is disposed. For the upper conveying downstream screw 118 as well, an upper conveying downstream screw first regulating portion 118*a* and an upper conveying downstream screw second regulating portion 118*b*, located at an opposite position of the upper conveying downstream screw first regulating portion 118*a*, are disposed, as the second regulating portion (protruded portion), at the upstream side end portion 118C, which is an end portion on the side where an engaging portion with the upper conveying upstream screw 115 is disposed. In the case of the upper conveying upstream screw 115, if the downstream side end portion 115C becomes unstable and the position of the center shaft line (rotational axis) starts to deviate from the original position, for example, at least one of the upper conveying upstream screw first regulating portion 115*a* and the upper conveying upstream screw second regulating portion 115*b* contacts the upper conveying upstream wall face 114. In the case of the upper conveying downstream screw 118 as well, if the upstream side end portion 118C becomes unstable and the position of the center shaft line (rotational axis) starts to deviate from the original position, for example, at least one of the upper conveying downstream screw first regulating portion 118*a* and the upper conveying downstream screw second regulating portion 118*b* contacts the upper conveying downstream wall face 117. By this contact of each regulating portion with the toner conveying passage forming the wall face, the misalignment between the upper conveying upstream screw 115 and the upper conveying downstream screw 118 can be controlled within a range in which the engaging of these screws is not disturbed. As a result, the occurrence of an engagement failure between the upper conveying upstream screw 115 and the upper conveying downstream screw 118, caused by misalignment thereof, can be suppressed.

The regulating portions will be further described in detail. The upper conveying upstream screw first regulating portion 115*a* and the upper conveying upstream screw second regulating portion 115*b* are disposed in the downstream side end portion 115C, at positions (different positions in the rotating direction of the upper conveying upstream screw 115), so as to be approximately opposite phases from each other in the circumference direction with respect to the shaft line (phases around the shaft line). Each of the upper conveying upstream screw first regulating portion 115*a* and the upper conveying upstream screw second regulating portion 115*b* is a protruded portion, which protrudes from the outer peripheral surface near the downstream side end portion 115C of the rotation shaft 115A, approximately in the diameter direction when the shaft line of the rotation shaft 115A is regarded as the center. The upper conveying upstream screw first regulating portion 115*a* (first protruded portion) and the upper conveying upstream screw second regulating portion 115*b* (third protruded portion) are disposed on the opposite sides with respect to the rotation shaft 115A. In other words, in the view from the direction orthogonal to the shaft line of the rotation shaft 115A, the upper conveying upstream screw first regulating portion 115*a* and the upper conveying upstream screw second regulating portion 115*b* overlap with the upper conveying upstream wall face 114 and the recessed portion 115*c*2. The upper conveying upstream screw first regulating portion 115*a* and the upper conveying upstream screw second regulating portion 115*b* extend in the diameter direction toward the upper conveying upstream wall face 114 (first inner wall face), and also extend toward the tip of the downstream side end portion 115C along the axial direction of the rotation shaft 115A. In other words, in the axial direction of the rotation shaft 115A, the upper conveying upstream screw first regulating portion 115*a* and the upper conveying upstream screw second regulating portion 115*b* extend in a direction from the conveying surface of the blade portion 115B toward the upper conveying downstream screw 118. In particular, the upper conveying upstream screw first regulating portion 115*a* is disposed so as to protrude integrally with the blade portion 115B in the axial direction of the rotation shaft 115A, from the downstream side end portion of the blade portion 115B which extends helically. Therefore in the view from the direction orthogonal to the shaft line of the rotation shaft 115A, a part of the upper conveying upstream screw first regulating portion 115*a* overlaps with the blade portion 115B. Further, the upper conveying upstream screw second regulating portion 115*b* is disposed so as to extend in the axial direction of the rotation shaft 115A from the position, of which phase is 180° in front (upstream side) of the downstream side end portion on the helical conveying surface of the blade portion 115B. Therefore in the view from the direction orthogonal to the shaft line of the rotation shaft 115A, a part of the upper conveying upstream screw second regulating portion 115*b* overlaps with the blade portion 115B. The heights of the upper conveying upstream screw first regulating portion 115*a* and the upper conveying upstream screw second regulating portion 115*b*, in the diameter direction from the outer peripheral surface of the rotation shaft 115A, are approximately the same as the maximum outer diameter of the blade portion 115B.

Further, in the view from the direction vertical to the axial direction, the upper conveying upstream screw first regulating portion 115*a* and the upper conveying upstream screw second regulating portion 115*b* are disposed so as to overlap with the above mentioned recessed/protruded engaging portions of the upper conveying upstream screw 115 and the upper conveying downstream screw 118.

The upper conveying downstream screw first regulating portion 118*a* and the upper conveying downstream screw second regulating portion 118*b* are also configured in the same way as the upper conveying upstream screw first regulating portion 115*a* and the upper conveying upstream screw second regulating portion 115*b*. In other words, the upper conveying downstream screw first regulating portion 118*a* and the upper conveying downstream screw second regulating portion 118*b* are disposed in the upstream side end portion 118C, at positions (different positions in the rotating direction of the upper conveying downstream screw 118), so as to be approximately opposite phases from each other in the circumference direction with respect to the shaft line. Each of the upper conveying downstream screw first regulating portion 118*a* and the upper conveying downstream screw second regulating portion 118*b* is a protruded portion, which protrudes from the outer peripheral surface near the upstream side end portion 118C of the rotation shaft 118A, approximately in the diameter direction when the shaft line of the rotation shaft 118A is regarded as the center. The upper conveying downstream screw first regulating portion 118*a* (second protruded portion) and the upper conveying downstream screw second regulating portion 118*b* (fourth protruded portion) are disposed on the opposite sides with respect to the rotation shaft 115A. In other words, in the view from the shaft direction of the rotation shaft 118A, the upper conveying downstream screw first regulating portion 118*a* and the upper conveying downstream screw second regulating portion 118*b* overlap with the upper conveying downstream wall face 117. The upper conveying downstream screw first regulating portion 118*a* and the upper conveying downstream screw second regulating portion 118*b* extend in the diameter direction toward the upper conveying downstream wall face 117 (second inner wall face), and also extend toward the tip of the upstream side end portion 118C along the axial direction of the rotation shaft 118A. In other words, in the axial direction of the rotation shaft 118A, the upper conveying downstream screw first regulating portion 118*a* and the upper conveying downstream screw second regulating portion 118*b* extend in a direction from the rear face of the conveying surface of blade portion 118B toward the upper conveying upstream screw 115. In particular, the upper conveying downstream screw first regulating portion 118*a* is disposed so as to protrude integrally with the blade portion 118B in the axial direction of the rotation shaft 118A, from the upstream side end portion of the blade portion 118B which extends helically. Therefore in the view from the axial direction of the rotation shaft 118A, a part of the upper conveying downstream screw first regulating portion 118*a* overlaps with the blade portion 118B. Further, the upper conveying downstream screw second regulating portion 118*b* is disposed so as to extend in the axial direction of the rotation shaft 118A from the position of which phase is 180° at the downstream side from the upstream side end portion on the rear face of the helical conveying surface of the blade portion 118B. Therefore in the view from the axial direction of the rotation shaft 118A, a part of the upper conveying downstream screw second regulating portion 118*b* overlaps with the blade portion 118B. The heights of the upper conveying downstream screw first regulating portion 118*a* and the upper conveying downstream screw second regulating portion 118*b*, in the diameter direction from the outer peripheral surface of the rotation shaft 118A, are approximately the same as the maximum outer diameter of the blade portion 118B.

As mentioned above, a plurality of regulating portions disposed in each screw are disposed at different positions by about 180° in the circumferential direction of the screw with the shaft line as the center. In the case of the configuration where the inner wall face constituting the conveying passage surrounds the outer periphery of the screw like a tube of which cross-section is circular, a sufficient misalignment prevention effect can be expected if the regulating portion is disposed at two locations of which phases are different by 180°. In other words, among the diameter directions with the rotational axis of the screw as the center, the direction passing through the 2 regulating portions and the screw rotation shaft is the direction in which the outer diameter width is widest in a screw outer shape viewed from the direction of the rotational axis. Not only in the case where the end portion of the screw shifts in this direction due to instability, but also in the case where the end portion of the screw shifts in a direction at a certain angle from this direction, the direction in which the end portion moves is a direction toward the region narrower than the maximum outer diameter width of the screw on the inner wall face constituting the conveying passage. This means that if the end portion of the screw becomes unstable, at least one of the 2 regulating portions contacts the inner wall face constituting the conveying passage. A number of regulating portions disposed here is not limited to 2, but may be 3 or more.

As described above, according to the present embodiment, the generation of an engagement failure of the upper conveying upstream screw 115 and the upper conveying downstream screw 118 caused by misalignment can be prevented. As a result, operability to replace the toner conveying unit can be improved. Further, a long and narrow toner conveying passage can be divided if the configuration to engage a plurality of conveying units is used, hence the long and narrow toner conveying unit can be implemented without being influenced by the constraints of the manufacture of dies.

In the present embodiment, a configuration where the toner conveying passage 119 (rotation shafts 115A and 118A of the screws 115 and 118) extends in the vertical direction was described, but the present invention is not limited to this configuration. For example, even in the case where the generation of a misalignment becomes an issue in a configuration where the toner conveying passage extends in a direction slightly inclined from the vertical direction, or in the horizontal direction, the misalignment prevent mechanism of the present invention can be suitably applied, just like the case of the present embodiment.

Further, the toner conveying device of the present invention can be used not only for conveying new toner, as described in the above embodiment, but also for conveying waste toner, such as untransferred toner. In this case, the powder to be conveyed may include not only waste toner but also such powder as paper dust generated from recording materials, and, all this being said, powder to be conveyed is mainly waste toner. Using the same configuration as the present embodiment, such target powder can also be conveyed efficiently, just like the case of the present embodiment.

Embodiment 2

Figure 6A:
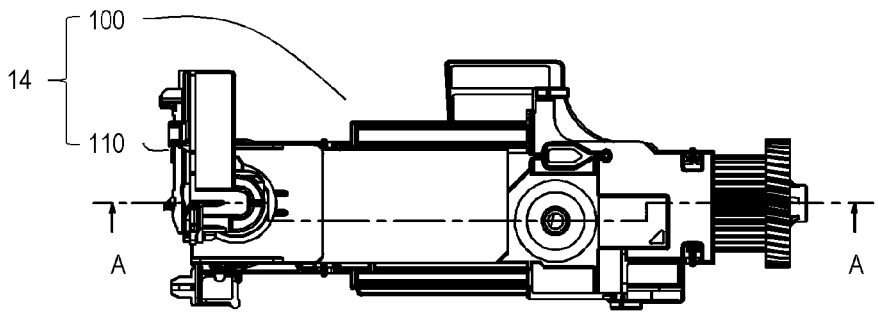
FIGS. 6A and 6B are views depicting a configuration of a toner conveying device in a disassembled state according to Embodiment 2 of the present embodiment.
Figure 6B:
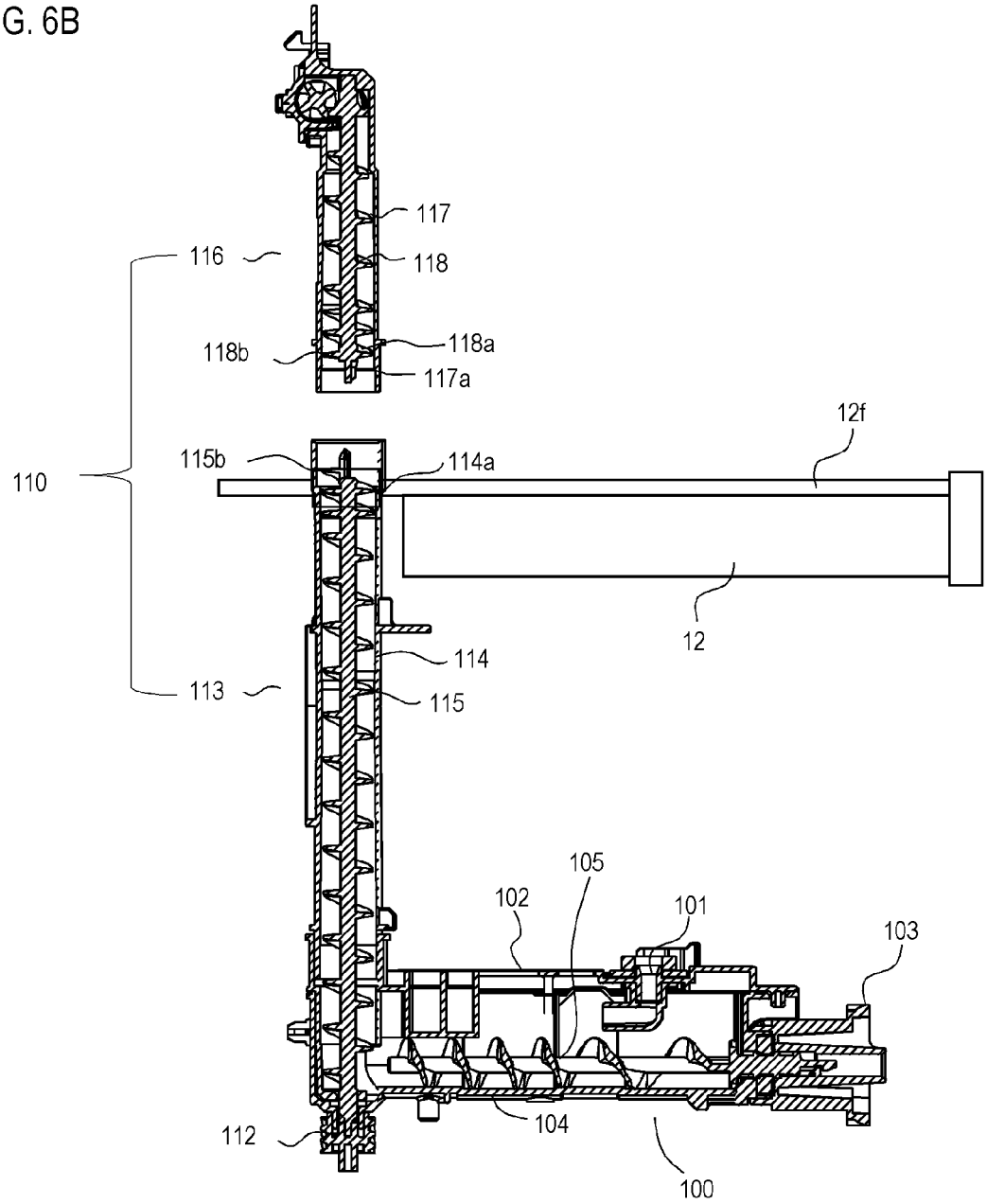
Figure 7A:
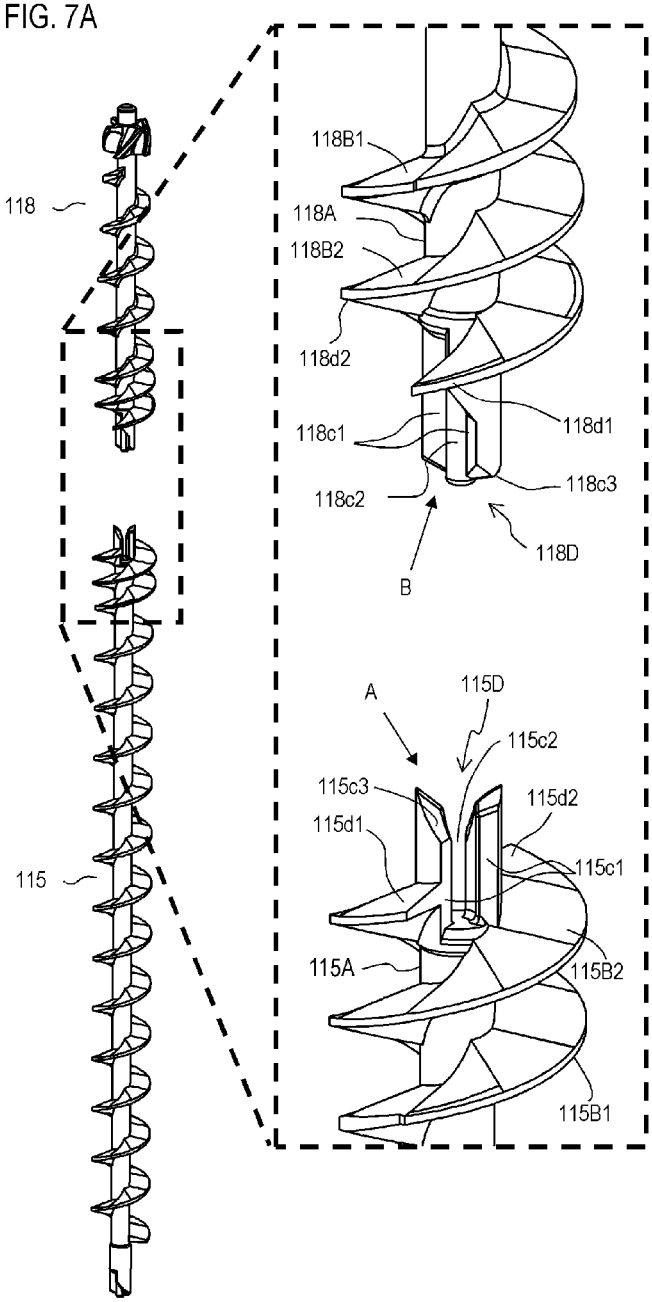
FIGS. 7A to 7C are views depicting a configuration of the toner conveying device in a disassembled state according to Embodiment 2 of the present embodiment.
Figure 7B:
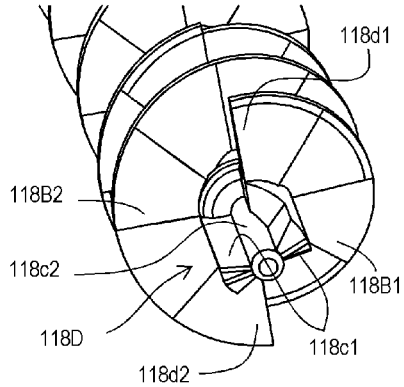
Figure 7C:
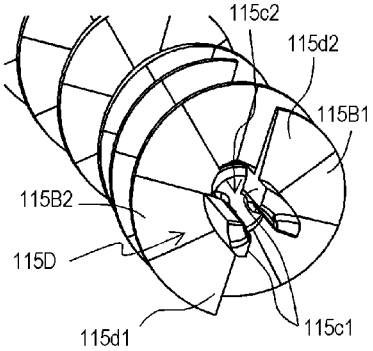

Embodiment 2 of the present invention will be described with reference to FIGS. 6A, 6B, and FIGS. 7A to 7C. FIGS. 6A and 6B indicate a disassembled state of the toner conveying device 14 according to Embodiment 2 in the case of service (maintenance). FIGS. 7A to 7C are views depicting a configuration of engaging portions and regulating portions of the upper conveying upstream screw 115 and the upper conveying downstream screw 118, where FIG. 7A is a schematic diagram depicting a general configuration of both screws, FIG. 7B is an arrow view from the direction B in FIG. 7A, and FIG. 7C is an arrow view from the direction A in FIG. 7A. In the configurations of the image forming apparatus and the toner conveying device according to Embodiment 2, a composing element the same as the device configuration of Embodiment 1 is denoted with a same reference sign, and redundant description thereof is omitted. In Embodiment 2, issues not specifically described herein are the same as Embodiment 1.

While one line of the helical blade portion is disposed in each screw in Embodiment 1, the screw in Embodiment 2 includes a plurality of lines of helical blade portions. In other words, in Embodiment 2, each of the upper conveying upstream screw 115 and the upper conveying downstream screw 118 is configured such that 2 blade portions extend helically in the axial direction, while maintaining a constant phase interval around the shaft line of the screw rotation shaft, and the end portion of each blade portion functions in the same manner as the regulating portion (protruded portion) of Embodiment 1. In the case of Embodiment 2, just like Embodiment 1, misalignment of the upper conveying upstream screw 115 and the upper conveying downstream screw 118 can be prevented, and toner can be conveyed stably.

As illustrated in FIGS. 7A to 7C, for the upper conveying upstream screw 115, a first blade portion 115B1 and a third blade portion 115B2 are helically extended on the outer peripheral surface of the rotation shaft 115A respectively, while maintaining phases that are different by 180° (while maintaining a 180° phase difference (first phase difference)) with respect to the shaft line of the rotation shaft 115A as the center. In the axial direction of the rotation shaft 115A, the first blade portion 115B1 extends throughout almost the entire region of the outer peripheral surface of the rotation shaft 115A, but the third blade portion 115B2 extends only in the downstream side end portion 115D of the upper conveying upstream screw 115. In other words, in a region of the outer peripheral surface of the rotation shaft 115A excluding the downstream side end portion 115D, only the first blade portion 115B1 is disposed and the third blade portion 115B2 is not disposed. The phase with respect to the shaft line of the rotation shaft 115A as the center (phase around the shaft line) of a downstream side end portion 115*d*1 of the first blade portion 115B1 and that of a downstream side end portion 115*d*2 of the third blade portion 115B2 are shifted by approximately 180°. These end portions 115*d*1 and 115*d*2 play the same function as the first regulating portion of Embodiment 1.

In the same manner, for the upper conveying downstream screw 118, a second blade portion 118B1 and a fourth blade portion 118B2 are helically extended on the outer peripheral surface of the rotation shaft 118A respectively, while maintaining phases that are different by 180° (while maintaining a 180° phase difference (second phase difference)) with respect to the shaft line of the rotation shaft 118A as the center. In the axial direction of the rotation shaft 118A, the second blade portion 118B1 extends throughout almost the entire region of the outer peripheral surface of the rotation shaft 118A, but the fourth blade portion 118B2 extends only in the upstream side end portion 118D of the upper conveying downstream screw 118. In other words, in a region of the outer peripheral surface of the rotation shaft 118A excluding the upstream side end portion 118D, only the second blade portion 118B1 is disposed, and the fourth blade portion 118B2 is not disposed. The phase, with respect to the shaft line of the rotation shaft 118A as the center (phase around the shaft line) of an upstream side end portion 118*d*1 of the second blade portion 118B1 and that of the upstream side end portion 118*d*2 of the fourth blade portion 118B2, are shifted away from each other by approximately 180°. These end portions 118*d*1 and 118*d*2 play the same function as the second regulating portion of Embodiment 1.

Further, in Embodiment 2, in a state where the downstream side end portion 115D of the upper conveying upstream screw 115 and the upstream side end portion 118D of the upper conveying downstream screw 118 are engaged, the respective blade portions are connected and form one (one line of the) blade portion. In other words, the downstream side end portion 115*d*1 of the first blade portion 115B1 of the upper conveying upstream screw 115 and the upstream side end portion 118*d*1 of the second blade portion 118B1 of the upper conveying downstream screw 118 contact with each other around the shaft line, and form one line of the blade portion. In the same manner, the downstream side end portion 115*d*2 of the third blade portion 115B2 of the upper conveying upstream screw 115 and the upstream side end portion 118*d*2 of the fourth blade portion 118B2 of the upper conveying downstream screw 118 contact with each other around the shaft line, and form one line of the blade portion.

Further, the end portions 115*d*1 and 115*d*2 and the end portions 118*d*1 and 118*d*2 are disposed so as to overlap with the recessed/protruded engaging portions of the upper conveying upstream screw 115 and the upper conveying downstream screw 118 in the axial direction. Furthermore, each end face of the end portions 115*d*1 and 115*d*2 and the end portions 118*d*1 and 118*d*2 (end faces that extend in the direction parallel with the rotational axis of each rotation shaft, and in the diameter direction with the rotational axis as the center) are configured to form a same surface with the driving transfer face 115*c*1 and the driving transfer face 118*c*1 in the engaging portions respectively.

By this configuration, the engaging state of the upper conveying upstream screw 115 and the upper conveying downstream screw 118 can be further stabilized, and the toner conveying performance can be further improved.

In the example of the present embodiment, a plurality of blades that are disposed are 2 blades, but may be 3 or more blades.

In Embodiments 1 and 2 described above, in the engaging portions of the upper conveying upstream screw and the upper conveying downstream screw, the phases in the circumference direction of the driving transfer surfaces 115*c*1 and 118*c*1, which are the contact surfaces in the circumference direction, are shifted at 180° intervals at 2 locations on a surface in the same direction, but may be shifted at 120° intervals at 3 locations, or 90° intervals at 4 locations. In this case, it is preferable to set the phase intervals between the first regulating portions 115*a* and 115*b* and the second regulating portions 118*a* and 118*b*, and the positions of the downstream side end portions 115*d*1 and 115*d*2 and the upstream side end portions 118*d*1 and 118*d*2 respectively, depending on the engaging locations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-046198, filed on Mar. 19, 2021, which is hereby incorporated by reference herein in its entirety.

What is claimed is:

1. A toner conveying device for conveying toner, comprising:

a first conveying portion configured to convey the toner; and a second conveying portion configured to convey the toner conveyed from the first conveying portion, wherein the first conveying portion includes:

a first screw that is rotatable around a first rotational axis and includes a first rotation shaft and a first blade portion which has a helix shape with the first rotational axis as a helical axis and which is disposed on an outer peripheral surface of the first rotation shaft, the first screw including, in a first end portion of the first rotation shaft in a direction of the first rotational axis, an engaging portion, and a first protruded portion which is protruded from the first rotation shaft in a direction intersecting with the first rotational axis; and a first conveying passage forming member having a first inner wall face which forms a first conveying passage inside which the first screw is disposed, the first inner wall face extending in the direction of the first rotational axis, so as to overlap with the first protruded portion when viewed in a direction orthogonal to the first rotational axis, wherein the second conveying portion includes:

a second screw that is rotatable around a second rotational axis and includes a second rotation shaft and a second blade portion which has a helix shape with the second rotational axis of the second rotation shaft as a helical axis and which is disposed on an outer peripheral surface of the second rotation shaft, the second screw including, in a second end portion of the second rotation shaft in a direction of the second rotational axis, an engaged portion, which engages with the engaging portion of the first screw so that the second screw is rotated by the rotation of the first screw, and a second protruded portion which is protruded from the second rotation shaft in a direction intersecting with the second rotational axis; and a second conveying passage forming member having a second inner wall face which forms a second conveying passage inside which the second screw is disposed, the second conveying passage forming member being connected with the first conveying passage forming member, the second inner wall face extending in the direction of the second rotational axis, so as to overlap with the second protruded portion when viewed in a direction orthogonal to the second rotational axis, wherein the first protruded portion is a third blade portion which has a helix shape with the first rotational axis as the helical axis and which is disposed on the outer peripheral surface of the first rotation shaft so as to have a first phase difference from the first blade portion in a rotation direction of the first rotation shaft, and wherein the second protruded portion is a fourth blade portion which has a helix shape with the second rotational axis as the helical axis and which is disposed on the outer peripheral surface of the second rotation shaft so as to have a second phase difference from the second blade portion in a rotation direction of the second rotation shaft.

2. The toner conveying device according to claim 1, wherein at least a part of the first protruded portion overlaps with the first blade portion when viewed in the direction orthogonal to the first rotational axis, and wherein at least a part of the second protruded portion overlaps with the second blade portion when viewed in the direction orthogonal to the second rotational axis.

3. The toner conveying device according to claim 1, wherein, on the outer peripheral surface of the first shaft portion, excluding the first end portion, the first screw has a region in which the first blade portion is disposed and the third blade portion is not disposed, and wherein, on the outer peripheral surface of the second shaft portion, excluding the second end portion, the second screw has a region in which the second blade portion is disposed and the fourth blade portion is not disposed.

4. The toner conveying device according to claim 1, wherein the engaging portion of the first screw is a recessed portion which is recessed from an end face of the first rotation shaft on a side of the first end portion in the direction of the first rotational axis, and the recessed portion overlaps with the first protruded portion when viewed in the direction orthogonal to the first rotational axis, and wherein the engaged portion of the second screw is a protruded portion, which is a protrusion on the end face of the first rotation shaft on a side of the second end portion.

5. The toner conveying device according to claim 1, wherein the toner conveying device is oriented in a direction in which the toner conveying device is installed in an apparatus main body in an image forming apparatus, the first rotational axis and the second rotational axis extend upward, and the second conveying portion is above the first conveying portion.

6. The toner conveying device according to claim 5, wherein the first inner wall face of the first conveying passage forming member covers, from outside of the second conveying passage forming member, an end portion of the second conveying passage forming member, which is on a side of the second end portion in the second rotational axis.

7. The toner conveying device according to claim 6, wherein the first rotational axis and the second rotational axis extend in a gravity direction.

8. A toner conveying device for conveying toner, comprising:

a first conveying portion configured to convey the toner; and a second conveying portion configured to convey the toner conveyed from the first conveying portion, wherein the first conveying portion includes:

a first screw that is rotatable around a first rotational axis and includes a first rotation shaft and a first blade portion which has a helix shape with the first rotational axis as a helical axis and which is disposed on an outer peripheral surface of the first rotation shaft, the first screw including, in a first end portion of the first rotation shaft in a direction of the first rotational axis, an engaging portion and a first protruded portion which is protruded from the first rotation shaft in a direction intersecting with the first rotational axis; and a first conveying passage forming member having a first inner wall face which forms a first conveying passage inside which the first screw is disposed, the first inner wall face extending in the direction of the first rotational axis, so as to overlap with the first protruded portion when viewed in a direction orthogonal to the first rotational axis, wherein the second conveying portion includes:

a second screw that is rotatable around a second rotational axis and includes a second rotation shaft and a second blade portion which has a helix shape with the second rotational axis of the second rotation shaft as a helical axis and which is disposed on an outer peripheral surface of the second rotation axis. the second screw includina. in a second end portion of the second rotation shaft in a direction of the second rotational axis, an engaged portion, which engages with the engaging portion of the first screw so that the second screw is rotated by the rotation of the first screw, and a second protruded portion protruded from the second rotation shaft in a direction intersecting with the second rotational axis; and a second conveying passage forming member having a second inner wall face which forms a second conveying passage inside which the second screw is disposed, the second conveying passage forming member being connected with the first conveying passage forming member, the second inner wall face extending in the direction of the second rotational axis, so as to overlap with the second protruded portion when viewed in a direction orthogonal to the second rotational axis, wherein the first protruded portion extends from a conveying surface of the first blade portion toward the second screw in the direction of the first rotational axis, and wherein the second protruded portion extends from a rear face of a conveying surface of the second blade portion toward the first screw in the direction of the second rotational axis.

9. A toner conveying device for conveying toner, comprising:

a first conveying portion configured to convey the toner; and a second conveying portion configured to convey the toner conveyed from the first conveying portion, wherein the first conveying portion includes:

a first screw that is rotatable around a first rotational axis and includes a first rotation shaft and a first blade portion which has a helix shape with the first rotational axis as a helical axis and which is disposed on an outer peripheral surface of the first rotation shaft, the first screw including, in a first end portion of the first rotation shaft in a direction of the first rotational axis, an engaging portion and a first protruded portion which is protruded from the first rotation shaft in a direction intersecting with the first rotational axis, the first protruded portion being provided only in the first end portion of the first rotation shaft; and a first conveying passage forming member having a first inner wall face which forms a first conveying passage inside which the first screw is disposed, the first inner wall face extending in the direction of the first rotational axis, so as to overlap with the first protruded portion when viewed in a direction orthogonal to the first rotational axis, wherein the second conveying portion includes:

a second screw that is rotatable around a second rotational axis and includes a second rotation shaft and a second blade portion which has a helix shape with the second rotational axis of the second rotation shaft as a helical axis and which is disposed on an outer peripheral surface of the second rotation axis, the second screw including, in a second end portion of the second rotation shaft in a direction of the second rotational axis, an engaged portion, which engages with the engaging portion of the first screw so that the second screw is rotated by the rotation of the first screw, and a second protruded portion protruded from the second rotation shaft in a direction intersecting with the second rotational axis, the second protruded portion being provided only in the second end portion of the second rotation shaft; and a second conveying passage forming member having a second inner wall face which forms a second conveying passage inside which the second screw is disposed, the second conveying passage forming member being connected with the first conveying passage forming member, the second inner wall face extending in the direction of the second rotational axis, so as to overlap with the second protruded portion when viewed in a direction orthogonal to the second rotational axis.

10. The toner conveying device according to claim 9, wherein the first screw includes a third protruded portion which is protruded from the first rotation shaft in a direction opposite to a direction in which the first protruded portion is protruded, and is provided opposite to the first protruded portion with respect to the first shaft portion in the direction orthogonal to the first rotational axis, and wherein the second screw includes a fourth protruded portion which is protruded from the second rotation shaft in a direction opposite to a direction in which the second protruded portion is protruded, and is provided opposite to the second protruded portion with respect to the second shaft portion in the direction orthogonal to the second rotational axis.

* * * * *